United States Patent [19]

Boshold

[11] Patent Number: 4,694,673

[45] Date of Patent: Sep. 22, 1987

[54] CONTAINER GUIDANCE SYSTEM FOR EXTRUSION PRESS

[75] Inventor: Raymond F. Boshold, Springfield, Pa.

[73] Assignee: Wean Industries, Inc., Youngstown, Ohio

[21] Appl. No.: 804,033

[22] Filed: Dec. 3, 1985

[51] Int. Cl.[4] ..... B21C 27/00

[52] U.S. Cl. ..... 72/272; 72/456

[58] Field of Search ..... 72/272, 456

[56] References Cited

U.S. PATENT DOCUMENTS

| | | | |
|---|---|---|---|
| 999,662 | 8/1911 | Lane et al. | 72/456 |
| 1,676,401 | 7/1928 | Lorant | 72/272 |
| 2,075,803 | 4/1937 | Dinzl et al. | 72/272 |

FOREIGN PATENT DOCUMENTS

| | | | |
|---|---|---|---|
| 644174 | 4/1937 | Fed. Rep. of Germany | 72/272 |
| S 36517 | 8/1956 | Fed. Rep. of Germany | 72/272 |

*Primary Examiner*—Lowell A. Larson

*Attorney, Agent, or Firm*—Warren N. Low; Renee S. Rutkowski

[57] ABSTRACT

A container guidance system for extrusion presses wherein heat-induced misalignment of the container and container holder from the press centerline axis is prevented or rendered negligible by the substantially diametric positioning of the container holder lugs and their press frame-associated guideways.

8 Claims, 5 Drawing Figures

CONTAINER GUIDANCE SYSTEM FOR EXTRUSION PRESS

BACKGROUND OF THE INVENTION

In the practice of extrusion of billets, including hot billets or hot-lubricated billets, for example, in horizontal extrusion presses of well-known form, a reliable and adjustable mounting of the billet container and its annular holder is of critical importance so that the centerline of the container may be truly aligned and thereafter maintained in alignment with the centerline of the extrusion press as whole, and thereby a proper extrusion can be forced through the usual downstream die or die stack by a ram, dummy block thereon, or the like.

It is conventional and well-known practice to provide means such as shims, wedges, threadable bolt or jackscrew arrangements and the like to effect adjustable vertical and horizontal positioning of the support or holder for the extrusion container, and wherein the container holder is suitably guided in ways for appropriate axially limited motion of the container holder along the centerline of the press.

Hitherto, container holders have commonly been provided with angularly related, radially extending fins or ribs which would be received upon like radially oriented guideways angularly related to each other and to a horizontal plane through the press centerline. See, for example, my prior U.S. Pat. No. 4,244,205, issued Jan. 13, 1981, or Muller U.S. Pat. No. 3,350,910, issued Nov. 7, 1967.

Such angular ways may be in various locations, but typically are at about 120° and 240° locations (or about 4 o'clock and 8 o'clock positions) as viewed from the press centerline axis. Such mountings for the container holder were desireable in certain respects in that unavoidable thermal expansion of the press in use did not cause misalignment of the initially carefully axis-aligned holder and container inasmuch as thermal expansion of the steel press components acted substantially uniformly radially upon the radially oriented guideways for the container, and thus did not materially alter the relative position of the container with respect to the guideways and the press axis. Similarly, such angular ways did not present particular difficulty in effecting vertical adjustment of the container and holder in seeking initial axis alignment.

In contrast, however, lateral alignment thereof (i.e. right-left in a horizontal plane) with respect to the press centerline was exceedingly complex by virtue of the aforesaid radial and angular slideway support.

Further developmet in an effort to improve horizontal alignment led to the provision of similarly angularly extending fins or ribs on the holder, but which terminated in slide faces lying in a common plane parallel to a plane through the horizontal centerline of the press. Such an arrangement permitted equally ready vertical adjustment of the container holder, and furthermore permitted facile left-right or horizontal adjustment thereof to achieve axis alignment, wherein means, as a subjacent (or overhead) adjusting wedge, jackscrew or comparable means was accessibly provided as by a radially extending tongue at the 6 o'clock or 12 o'clock position on the container holder.

Such an arrangement obviated the difficulties of horizontal centerline accommodation while further enhancing easy vertical adjustment by shim or slide means or either side of the container.

While these latter improvements achieved much in the proper and precise alignment of the container with the press centerline, the same were now unable to prevent loss of alignment resulting from inescapable temperature rise and subsequent metal expansion of the container, holder, and press components generally, wherein radial expansion through the angular holder fins to the planar slide faces effected relative vertical displacement of the container with respect to the press axis.

As a consequence, an aligned container prior to heat buildup thereafter required highly difficult and indeed hazardous in-use realignment after heat-distorted shifting of the container with respect to the press axis. These aspects mitigate against the benefits obtained as to the initial ease of vertical and horizontal adjustment of the cool press.

The present invention obviates these difficulties in providing the same facile before-use press axis adjustment, while eliminating or rendering negligible any axis shift occurring from progressive thermal expansion of hot press components during press operation.

BRIEF SUMMARY OF THE INVENTION

The present invention provides unique yet structurally simple cooperative relationships hitherto unknown in the horizontal extrusion press art which substantially eliminate, and indeed in one form thereof totally eliminate, misalignment resulting from the thermal expansion of the container holder and press generally during operation, thereby obviating the difficult and unwanted necessity to correct misalignment developing during extrusion operations.

Further, as taught herein, the positioning of the laterally extending fins on the container holder permits a transverse shortening thereof, with resulting simplicity of construction and reduction of thermal expansion effects.

To this end, in accordance with the present invention, the fins or lugs of the container holder are so disposed with respect to the container holder and the receiving guideways therefor so as to lie substantially diametrically of the holder, while remaining in coplanar relation to each other. In such manner, thermal expansion of the container and holder has no, or virtually no, vertical component of motion to shift the container from the press centerline, whereby high quality and reliable extrusion is performed irrespective of the heated condition of the press equipment.

In one form of the invention, the resultant thermal shift may exist, but is so reduced in effect so as to be truly negligible, while at the same time, lowering the cost and simplifying container holder manufacture.

In a further form of the invention, the aforesaid thermal effects have no adverse impact upon container alignment whatever, which is highly desireable. In this modified form of the invention, however, the fabrication of the container holder is slightly more complex, although still easily achieved.

DESCRIPTION OF THE EMBODIMENTS OF THE INVENTION

Figure 1:
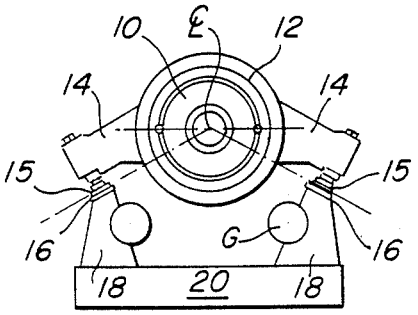
FIG. 1 (PRIOR ART)
FIG. 1 is a diagrammatic end view illustration of a container and holder therefor and associated guidance system in accordance with prior art teachings.

Referring to the drawings, and as discussed above, in FIG. 1 a typical prior art contruction is shown, as for example, that in Muller U.S. Pat. No. 3,350,910 and others, wherein the usual extrusion container 10 as seen in general end elevation is received within a surrounding cylindrical holder 12, which latter is provided with angularly extending ribs or fins 14, 14 having usual angularly disposed and radially extending wear faces 15, 15 thereon for slidable engagement with guideways 16, 16 therebeneath customarily provided on pedestal portions 18, 18 of the press frame 20. Such presses, including a plurality of container shifting cylinders G are conventional in the art and the detailed structure thereof not relevant to the instant invention is not shown for sake of clarity.

It will be seen that the container holder fins 14, 14 are angular with respect to each other, typically at about an 120° angle, or 60° on either side of a vertical plane through the press centerline axis at CL. While various means, as wedges and shims, readily effect vertical positioning of the container or adjustment thereof to ensure that the container centerline is coincident with that of the die stack, ram, etc. and press generally, it is inherently a complex operation to effect necessary side-to-side adjustment of the container and its holder by virtue of the respective radial and angular slideway and wearshoe engagement, as is apparent. With this known prior art construction, however, thermal expansion or elongation of the fins or lugs and the press components generally as the same significantly heat in use, presents no threat of serious centerline axis misalignment, as the thrust of the expansion will be essentially to radially elongate the lugs without realtively shifting the position of the container and holder with respect to the centerline axis.

Figure 2:
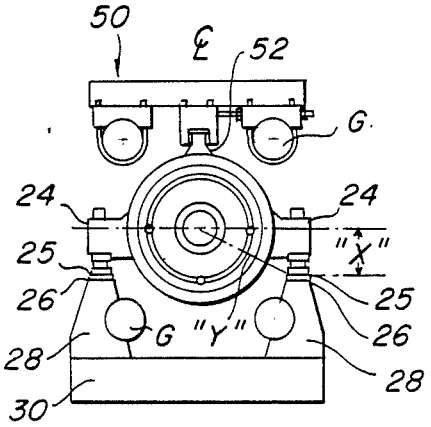
FIG. 2 (PRIOR ART)
FIG. 2 is a similar illustration of a further prior art teaching.

The difficulty of lateral or horizontal side-to-side adjustment of the container in its holder has been hitherto solved in one fashion as shown in FIG. 2. The prior art there illustrated provides the container holder 22 with laterally extending ribs or lugs 24, 24 having guideways at the 4 o'clock and 8 o'clock positions comparable to FIG. 1, but whose wear faces 25, 25 thereof lie in a common horizontal plane, and cooperate with suitable like horizontal guideways 26, 26 on support pedestals 28, 28 of a portion of the press frame thereat at 30.

With this particular prior art arrangement it will be seen that any necessary lateral adjustment of the container and holder to ensure centerline axis alignment may be easily effected by known means, as an overhead-mounted, jackscrew-adjusted laterally-acting jaw assembly 50 cooperating with an upstanding flange as at 52 on the container holder. It will be seen that the coplanar nature of the guideways 26 and slide faces thereabove do not impede such adjustment, as by the illustrative means 50, 52, which while shown in an overhead position, could with equal adjustment facility be in the 6 o'clock position in comparable form.

Unfortunately and unavoidably, however, as discussed above, high temperature rise with resultant thermal expansion occur during operation of the press. Which expansion acts generally upon press components, including the ribs or fins, the container, and its housing or holder. As indicated in FIG. 2, such expansion will effect elongation, for example, of the distance "Y" between the centerline CL and the guideways at 26. Consequently, this will also cause the vertical spacing "X" between the horizontal plane through the container centerline and slideways 25, 26 to alter and increase, thereby vertically shifting the container upward and throwing the same off-center with respect to the press axis, with resultant inescapable extruded work product deterioration from such press misalignment.

By way of example to dramatize the effect thereof, in an illustrative horizontal extrusion press of a size on the order of 2750 tons, the radial distance "Y" from centerline CL to the slideways 25, 26 may be typically 39 inches, while the angle thereof to a horizontal plane through the centerline may be on the order of 22½°. With an illustrative and likewise typical heat expansion factor for press steel of 0.00065 inches per inch per 100° F. degrees, the radial distance "Y" will increase substantially by as much as approximately eight-hundredths of one inch as the press heats form an ambient temperature of, say, 70° F. to 400° F. As a consequence, the vertical shift or elongation of distance "X" will approximate 0.031", or about 1/32", whereby the adjusted height position of the container is no longer on centerline, but removed therefrom by that amount, which is considerable. With such a throwoff of centerline, the press must be adjusted back to alignment in its "hot" condition, which is clearly undesireable and disadvantageous, in order to avoid defective work output.

The calculation is as follows for the example given:

"Y" becomes $39'' + (39'' \times 0.0065 \times 3.3)$, or 39.083".

Thus, the increase in "X" $= 0.083'' \times \text{SIN } 22.5° = 0.031''$

The difficulties of attempting such "hot press" readjustments are in addition to the fact that the misalignment of the container with the press axis is gradual or progressive as the press heats from an initial ambient temperature prior to reaching a final off-position at the attained press temperature, whereby the error is not uniform, but increasing for a period of time, further complicating proper (or repairable) output.

Figure 3:
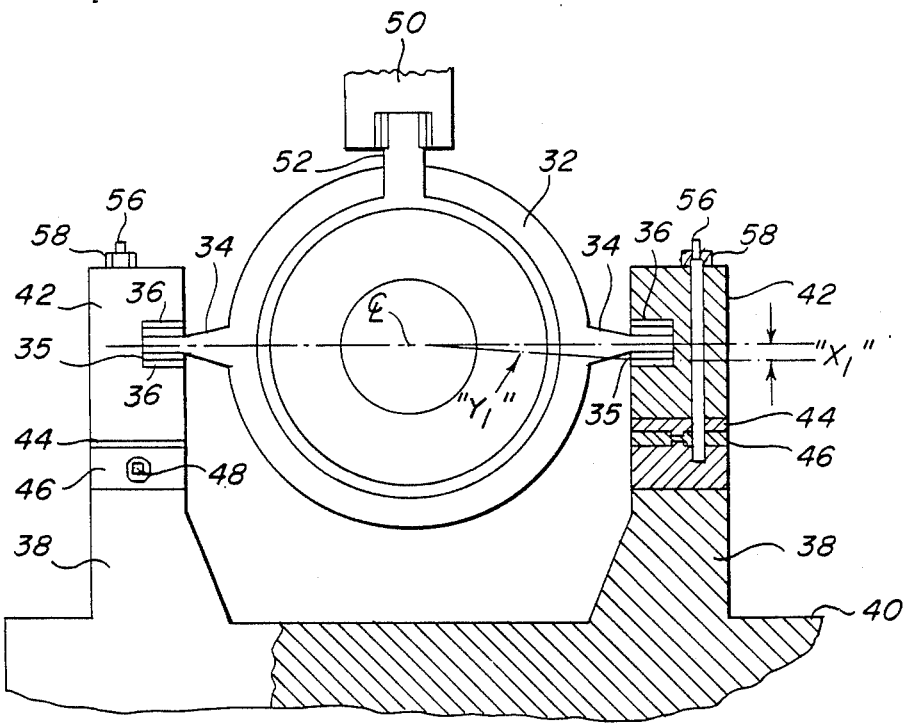
FIG. 3 is an end elevation of a container holder, guideway, and related parts in accordance with the invention, with portions thereof shown in section.

In the present invention, however, one form of which is as seen in FIG. 3, this thermal-induced misalignment is obviated or rendered negligible to the extent that no product difficulty ensues from press heating. More particularly, it will be seen in FIGS. 3 and 4 that the container holder 32 is provided with elongated ears or fins 34, 34 extending radially and diametrically thereof substantially symmetrically on either side of a plane through the centerline CL, the fins having wear plates 35, 35 along both the top and bottom extremities thereof for sliding cooperation with guideway faces 36, 36 embracing the same.

In so doing, and in a like comparison to the example above, the distance "$Y_1$" in a comparable press will shorten to about 31", as the effective vertical centerline of the pedstals 38, 38 is nearer the centerline axis CL of the press as compared with the FIG. 2 form. Furthermore, the angle between the centerline horizontal plane and line "$Y_1$" is sharply reduced to the order of only about 4°.

As a consequence, and under the same heating conditions, the elongation of distance "$X_1$" will only be on the order of four one-thousandths of an inch, or truly negligible.

As before, the computation is:

"$Y_1$"×31"+(31"×0.00065×3.3), or 3.066"; and, the increase in "$X_1$"=0.066×SIN4°=0.004".

In this one example, it will be seen that the offset is reduced from an intolerable 1/32" to a nominal 4/1000", or a reduction of about 87%. Comparable determinable figures follow for other like horizontal extrusion presses.

Further, it will be appreciated that the fabrication of the container holder fins 34 is simplified as the same lie in diametric and symmetric relation on either side of a horizontal plane through the centerline, while the lugs or fins themselves are shortened and are no longer asymmetric or complex as compared with the prior art of FIGS. 1 and 2.

Figure 4:
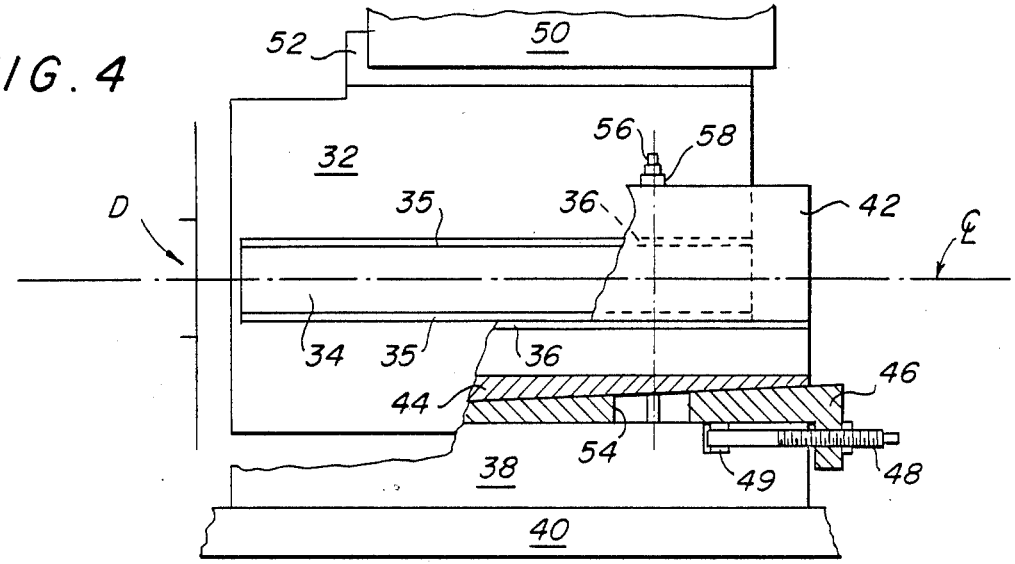
FIG. 4 is a side elevation of the holder and adjacent elements thereof in accordance with the invention, partially in section; and, FIG. 5 is an enlarged fragmentary elevation of a further form of the invention.

To complete the illustrative showing of the invention in FIG. 3 and, wherein the usual container shifting cylinders generally indicated at G in FIGS. 1 and 2, and other conventional press components have been omitted for clarity, it will be seen that the pedestals 38, 38 arise from a frame element 40 of the press, and are surmounted by the channelled blocks 42, 42 carrying the guideways 36, 36 and receiving the aforesaid short fins 34, 34 with their wear faces 35, 35, which permit container and holder movement toward and away from a die assembly, as at D (FIG. 4).

Conventional means, as discussed, may be provided to effect vertical adjustment of the container holder, as fixed and sliding wedges 44, 46 in the pedestals, wherein screw 48 tapped into a flange of wedge 46 in cooperation with a bearing nut 49 within pedestal 38 effects the relative movement for height adjustment.

The movable wedge 46 may be slotted along its length as at 54 to permit its longitudinal movement with respect to a plurality of elongated bolts securing the block and pedestal elements together, one being shown at 56, and having appropriate tightening nuts 58.

Figure 5:
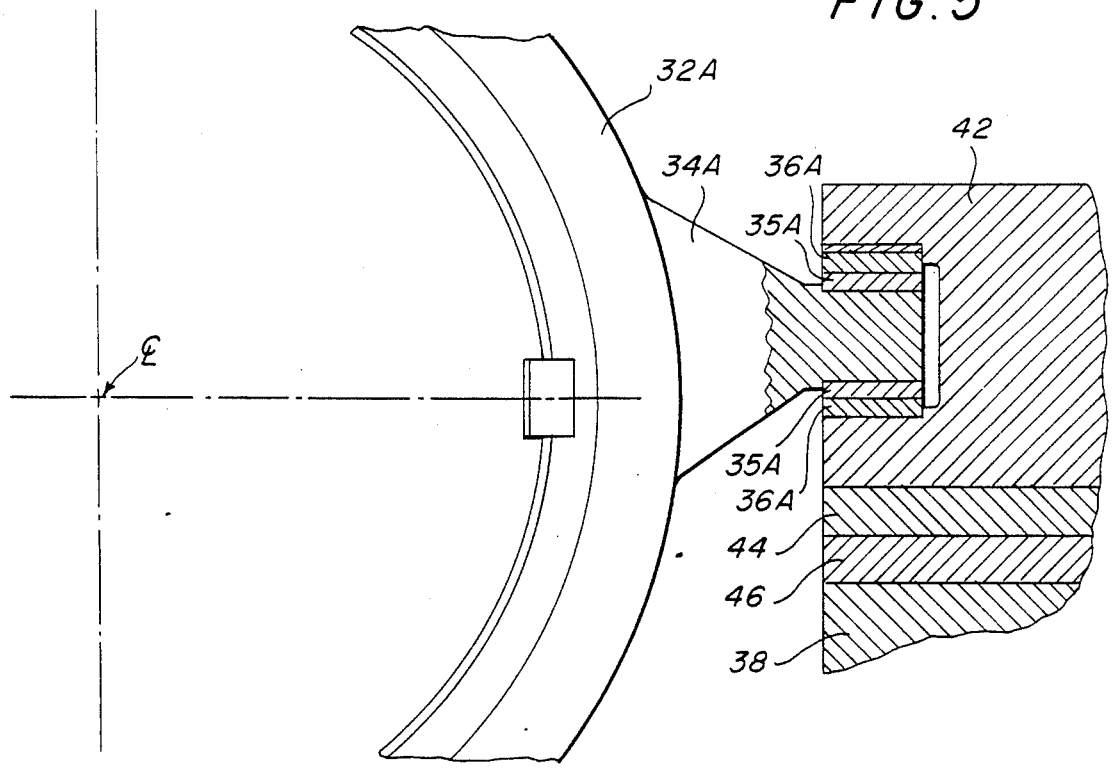

In a further form of the invention as seen in FIG. 5, and as indicated above, unwanted thermal expansion movement is eliminated altogether. To achieve this result, the zone of contact between the wear faces as right-hand wear face 35A of the holder fins 34A and the lower guideways as guideway 36A in FIG. 5, is so disposed as to lie in the horizontal plane through the centerline axis CL, as shown.

As such, the vertical distance as at "X" in FIG. 2 or "$X_1$" in FIG. 3 is eliminated altogether, along with any vertical relative shifting movement thereof as the press components expand under heat. The fabrication of the fins 34A is only slightly more complex than the FIG. 3 form as the same are no longer totally symmetrical about a diametric plane. This form of the invention may be utilized if it is deemed advisable or necessary to eliminate even the small amount of shifting present in the FIG. 3 form of the invention.

What is claimed is:

1. In an extrusion press having a frame, an extrusion die carried by the frame defining an operating centerline axis centrally thereof, a pair of longitudinally extending guideways carried by said frame on either side of said axis and parallel thereto, an extrusion container, a generally annular container holder concentrically of said axis, a single pair of fins extending outwardly from said container holder and having slide faces thereon for slide cooperation with said guideways, means for horizontally adjusting said container with respect to said centerline axis, and, means for vertically adjusting said guideways thereby to vertically adjust said container holder carried thereby to a desired alignment with said centerline axis;

the improvement therein to minimize shifting of said container holder from said predetermined axis alignment during press operation, comprising, said single pair of fin means having respective planar upper and lower slide faces thereon, said guideways respectively having a substantially C-shaped cross-section defing upper, lower, and side internal surfaces and having a lateral opening directed toward said holder, said frame having means positioning said guideways carried coplanar relation on either side of said container holder in substantially thereby in substantially diametric relation thereto, and, said container holder having the fins thereof extending substantially diametrically of said holder for respective reception within said guideways, whereby subsequent to vertical adjustment of said guideways to centerline axis alignment, vertical shifting of said guideways and said press frame and radial expansion of said container holder in response to press forces and thermal expansion during press operation is ineffective to materially after container centerline axis alignment.

2. The improved press of claim 1 wherein said lower fin slide faces and said guideway lower surfaces lie on an extended diametric plane of said container holder through said centerline axis thereby to obviate thermally induced expansion effects on axis alignment, and wherein said fins and said upper slide faces thereof lie entirely to one side of said extended diametric plane.

3. The improved press of claim 1 wherein said fin slide faces and said guideways respectively lie within an angle on the other of 4 degrees to one side of a diametric plane through the container holder.

4. The improved press of claim 1 wherein said guideways are carried by substantially vertical pedestals on either side of said container holder and said fins are of a minimum length in extending toward said pedestals to intercept the same perpendicularly thereto and susbstantially in the horizontal plane of the press centerline.

5. The improved press of claim 1 wherein wear plates are provided on both upper and lower slide faces of said fins for respective confronting cooperation with guideways for each said wear plate.

6. The improved press of claim 1 wherein said horizontal adjusting means includes a radially extending fin on said container holder in cooperative association with said frame-mounted guideways, with said fin being disposed at substantially 90° to said coplanar fin guideways, whereby said 90° relation between said vertical and horizontal fins permits adjustment of said container holder up or down without disturbance of any adjusted left-to-right position thereof, and vice versa.

7. The improved press of claim 1 wherein said means for positioning and vertically adjusting each said guideway includes a pair of mating wedges having complementary inclined faces on said frame means, and means for shifting one wedge with respect to the other along the inclined faces thereof.

8. The improved press of claim 7 wherein said C-shaped guidways are supported upon wedges.

* * * * *